US006803179B2

(12) United States Patent
Haye et al.

(10) Patent No.: US 6,803,179 B2
(45) Date of Patent: Oct. 12, 2004

(54) PHOTOGRAPHIC COLOR DEVELOPING COMPOSITION CONTAINING CALCIUM ION SEQUESTERING AGENT COMBINATION AND METHOD OF USE

(75) Inventors: Shirleyanne E. Haye, Rochester, NY (US); Janet M. Huston, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/639,538

(22) Filed: Aug. 12, 2003

(65) Prior Publication Data

US 2004/0048205 A1 Mar. 11, 2004

Related U.S. Application Data

(62) Division of application No. 10/216,942, filed on Aug. 12, 2002, now Pat. No. 6,645,709.

(51) Int. Cl.[7] ..... G03C 7/413
(52) U.S. Cl. ..... 430/450
(58) Field of Search ..... 430/450

(56) References Cited

U.S. PATENT DOCUMENTS

| | | | | |
|---|---|---|---|---|
| 4,264,716 | A | 4/1981 | Vincent et al. | 430/380 |
| 4,546,068 | A | 10/1985 | Kuse | 430/375 |
| 4,596,765 | A | 6/1986 | Kurematsu et al. | 430/467 |
| 4,615,971 | A | 10/1986 | Haseler | 430/491 |
| 4,816,384 | A | 3/1989 | Fruge et al. | 430/465 |
| 4,873,180 | A | 10/1989 | Marchesano et al. | 430/491 |
| 4,876,174 | A | 10/1989 | Ishikawa et al. | 430/380 |
| 4,892,804 | A | 1/1990 | Vincent et al. | 430/380 |
| 4,900,651 | A | 2/1990 | Ishikawa et al. | 430/380 |
| 4,923,782 | A | 5/1990 | Schwartz | 430/372 |
| 4,927,746 | A | 5/1990 | Schwartz | 430/372 |
| 4,975,357 | A | 12/1990 | Buongiorne et al. | 430/434 |
| 5,034,308 | A | 7/1991 | Abe et al. | 430/372 |
| 5,273,865 | A | 12/1993 | Loiacono et al. | 430/490 |
| 5,354,646 | A | 10/1994 | Kobayashi et al. | 430/372 |
| 5,660,974 | A | 8/1997 | Marrese et al. | 430/490 |
| 5,674,668 | A | 10/1997 | Hagemann et al. | 430/507 |
| 5,891,608 | A | 4/1999 | Hashimoto et al. | 430/458 |
| 5,914,221 | A | 6/1999 | Kim et al. | 430/466 |
| 6,017,687 | A | 1/2000 | Darmon et al. | 430/466 |
| 6,159,670 | A | 12/2000 | Buongiorne et al. | 430/491 |
| 6,403,290 | B1 | 6/2002 | Haye et al. | 430/357 |
| 6,416,940 | B2 | 7/2002 | Haye et al. | 430/466 |

FOREIGN PATENT DOCUMENTS

| | | |
|---|---|---|
| EP | 0 204 372 | 10/1986 |
| EP | 0 793 141 A2 | 3/1997 |
| EP | 0 800 111 A1 | 8/1997 |

OTHER PUBLICATIONS

*Research Disclosure*, publication 13410, Jun. 1975.
*Research Disclosure*, publication 20405, Apr. 1981.
*Research Disclosure*, publication 18837, Dec. 1979.
*Research Disclosure*, publication 22937, May, 1983.

*Primary Examiner*—Hoa Van Le
(74) *Attorney, Agent, or Firm*—J. Lanny Tucker

(57) ABSTRACT

Concentrated and working strength photographic color developing compositions are stabilized with the inclusion of two specific types of calcium ion sequestering agents. One of the sequestering agents is a polyelectrolyte such as a polycarboxylic acid or salt thereof having a molecular weight of from about 2000 to about 100,000. The other one is a non-polymeric aminocarboxylic acid, polyphosphonic acid, or a salt thereof. The weight ratio of the first calcium ion sequestering agent to the second calcium ion sequestering agent is from about 1:1 to about 20:1. These compositions can be used to process color photographic materials such as color photographic papers.

11 Claims, No Drawings

PHOTOGRAPHIC COLOR DEVELOPING COMPOSITION CONTAINING CALCIUM ION SEQUESTERING AGENT COMBINATION AND METHOD OF USE

CROSS-REFERENCE TO RELATED APPLICATION

This is a Divisional of application Ser. No. 10/216,942, filed Aug. 12, 2002, now allowed as U.S.Pat. No. 6,645,709.

FIELD OF THE INVENTION

The present invention relates to photographic color developing compositions that have improved stability, and to methods for their use. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al.) describes conventional color developing compositions that have found considerable commercial success in the photographic industry. Other known color developing compositions are described in U.S. Pat. No. 4,876,174 (ishikawa et al.), U.S. Pat. No. 5,354,646 (Kobayashi et al.), and U.S. Pat. No. 5,660,974 (Marrese et al.).

It is generally known that the concentrations of various photochemicals used in a photographic color developing composition must be within certain narrow limits in order to provide optimal performance. This is particularly true of "concentrates" or single-part compositions.

There is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

A very useful single-part color developing composition that is homogeneous, concentrated, and stable is described and claimed in U.S. Pat. No. 6,077,651 (Darmon et al.). Such compositions are stable from the presence of the free base form of the color developing agent and a particular amount of water-soluble organic solvent.

Stability of the color developing agents in such compositions is generally achieved using sulfite ions or any of the many conventional organic antioxidants (or preservatives) that reduce aerial oxidation rates. For example, U.S. Pat. No. 4,892,804, U.S. Pat. No. 4,876,174, U.S. Pat. No. 5,354,646, and U.S. Pat. No. 5,660,974 (all noted above) describe hundreds of possible derivatives of hydroxylamines that can be used as antioxidants in color developing compositions.

The color developing compositions used in the industry are mixed with water in various parts of the world where the concentration of "problem" ions such as calcium ions can vary considerably. High calcium ion content can cause precipitates that may be evident as scale or deposits on processing equipment.

To reduce the effect of such ions, color developing compositions generally contain a metal ion sequestering agent, similar to those described in *Research Disclosure*, publication 13410 (June 1975) and publication 20405 (April 1981). *Research Disclosure* is a publication of Kenneth Mason Publications Ltd., Dudley House, 12 North Street, Emsworth, Hampshire PO10 7DQ England (also available from Emsworth Design Inc., 147 West 24th Street, New York, N.Y., 10011).

Polyhydroxy compounds and aminopolyphosphonic acids are described as metal ion sequestering agents in U.S. Pat. No. 4,264,716 (Vincent et al.). Polyelectrolytes are described as calcium controlling agents in *Research Disclosure*, publication 22937 (May 1983). U.S. Pat. No. 6,416,940 (Haye et al.) describes the use of various polyphosphonic acids as calcium ion sequestering agents, including a mixture of such compounds with a polyacrylic acid wherein the weight ratio of polyacrylic acid to polyphosphonic acid is about 0.06:1.

Despite the description and use of various metal ion sequestering agents, there is a desire in the photoprocessing industry to find additional means for stabilizing color developing compositions, whether single-part or multi-part compositions, in the presence of calcium ions. Improved stabilization would enable any of the color developing compositions to be readily mixed with local water supplies that may be high in calcium ion content without adverse effects.

SUMMARY OF THE INVENTION

This invention addresses the problems noted above with an aqueous photographic color developing composition having a pH of from about 7 to about 13 and comprising:

a) at least 0.0005 mol/l of a color developing agent, b) at least 0.0005 mol/l of an antioxidant for the color developing agent, c) from about 1 to about 25 g/l of a first calcium ion sequestering agent that is a polycarboxylic acid or salt thereof having a molecular weight of from about 2000 to about 100,000, and d) at least 0.0005 mol/l of a second calcium ion sequestering agent that is a non-polymeric aminocarboxylic acid, polyphosphonic acid, or a salt thereof, wherein the weight ratio of the first calcium ion sequestering agent to the second calcium ion sequestering agent is from about 1:1 to about 20:1.

This invention also provides a concentrated, aqueous, single-part color developing composition having a pH of from about 8 to about 12 and comprising:

a) from about 0.005 to about 1 mol/l of a color developing agent in free base form, b) from about 0.005 to about 1 mol/l of a hydroxyl amine derivative antioxidant for the color developing agent, c) a water-miscible or water-soluble hydroxy-substituted, straight-chain organic solvent that has a molecular weight of from about 50 to about 200, d) a buffering agent that is soluble in the organic solvent, f) from about 1 to about 50 g/l of a first calcium ion sequestering agent that is a polycarboxylic acid or salt thereof having a molecular weight of from about 2000 to about 100,000, and g) from about 0.001 to about 0.3 mol/l of a second calcium ion sequestering agent that is a non-polymeric aminocarboxylic acid, polyphosphonic acid, or a salt thereof, wherein the weight ratio of the first calcium ion sequestering agent to the second calcium ion sequestering agent is from about 1:1 to about 15:1.

This invention also addresses the problems noted above with a two-part color developing kit comprising:

(I) a first aqueous solution having a pH of from about 9 to about 13, and (II) a second aqueous solution having a pH of from about 3 to about 7 and comprising:

(a) at least 0.005 mol/l of a color developing agent, (b) at least 0.005 mol/l of an antioxidant for the color developing agent, and (b) at least 0.001 mol/l of sulfite ions, further comprising, in the first aqueous solution, from about 1 to about 50 g/l of a first calcium ion sequestering agent that is a polycarboxylic acid or salt thereof having a molecular weight of from about 2000 to about 100,000, and in the first or second aqueous solution, or both, at least 0.0005 mol/l of a second calcium ion sequestering agent that is a non-polymeric aminocarboxylic acid, polyphosphonic acid, or a salt thereof, wherein the weight ratio of the first calcium ion sequestering agent to the second calcium ion sequestering agent is from about 1:1 to about 20:1 when the first and second aqueous solutions are mixed at a volume ratio of from about 2:1 to about 1:2.

Still again, this invention also provides a method of making a working strength color developing composition from the two aqueous solutions noted above comprising:

(A) combining the first and second aqueous solutions noted above in such a manner that the volume ratio of the first aqueous solution to the second concentrated aqueous solution is from about 2:1 to about 1:2, and, B) simultaneously or subsequently, diluting the first and second aqueous solutions with water in such a manner as to dilute the first concentrated aqueous solution at least 2 times and the second concentrated aqueous solution at least 2 times.

Further, this invention provides an advance in the art with a three-part color developing kit comprising:

(I) a first concentrated aqueous solution having a pH of from about 9 to about 13, (II) a second concentrated aqueous solution having a pH of from about 1 to about 4 and comprising:

(a) at least 0.005 mol/l of a color developing agent, and (b) at least 0.001 mol/l of sulfite ions, and (III) a third concentrated aqueous solution having a pH of from about 10 to about 13.5, wherein the first or second concentrated aqueous solution, or both, includes from about 1 to about 50 g/l of a first calcium ion sequestering agent that is a polycarboxylic acid or salt thereof having a molecular weight of from about 2000 to about 100,000, any of the first, second, and third concentrated aqueous solutions includes at least 0.001 mol/l of a second calcium ion sequestering agent that is a non-polymeric aminocarboxylic acid, polyphosphonic acid, or a salt thereof, and any of the first, second, and third concentrated aqueous solutions includes at least 0.005 mol/l of an antioxidant for the color developing agent, wherein the weight ratio of the first calcium ion sequestering agent to the second calcium ion sequestering agent is from about 1:1 to about 20:1 when the first, second, and third concentrated aqueous solutions are mixed at a volume ratio of 2:1:3.

This invention also provides a method of making a working strength color developing composition from the three concentrated aqueous solutions noted above comprising:

(A) combining the first, second, and third concentrated aqueous solutions noted above in such a manner that the volume ratio of the first concentrated aqueous solution to the second concentrated aqueous solution is from about 1:1 to about 1.5:1, the volume ratio of the first concentrated aqueous solution to the third concentrated aqueous solution is from about 1:1 to about 1.5:1, and the volume ratio of the second concentrated aqueous solution to the third concentrated aqueous solution is from about 1:1 to about 1.5:1, and, B) simultaneously or subsequently, diluting the first, second, and third concentrated aqueous solutions with water in such a manner as to dilute the first concentrated aqueous solution at least 8 times, the second concentrated aqueous solution at least 10 times, and the third concentrated aqueous solution at least 10 times.

A method for providing a color image in a color photographic silver halide element comprises contacting the element with an aqueous photographic color developing composition having a pH of from about 7 to about 13 and comprising:

a) at least 0.0005 mol/l of a color developing agent, b) at least 0.0005 mol/l of an antioxidant for the color developing agent, c) from about 1 to about 25 g/l of a first calcium ion sequestering agent that is a polycarboxylic acid or salt thereof having a molecular weight of from about 2000 to about 100,000, and d) at least 0.0005 mol/l of a second calcium ion sequestering agent that is a non-polymeric aminocarboxylic acid, polyphosphonic acid, or a salt thereof, wherein the weight ratio of the first calcium ion sequestering agent to the second calcium ion sequestering agent is from about 1:1 to about 20:1.

The same method can also be practiced using the two and three-part color developing composition kits described above, by combining the various parts (solutions) in the kit and contacting the color photographic silver halide element with the resulting solution.

In other embodiments of the invention, a method of photographic processing comprises the steps of:

A) color developing an imagewise exposed color photographic silver halide element with a photographic color developing composition containing the first and second calcium ion sequestering agents noted above, and B) desilvering the color developed color photographic silver halide element.

The color developing step in a photographic processing method can be followed by desilvering the color developed color photographic silver halide element, as well as any other useful photoprocessing steps known in the art.

The color developing composition is less susceptible to the formation of precipitates containing calcium ion because of the presence of two specific calcium sequestering agents. The combination of these two compounds is required to provide the desired results because each type of sequestering agent alone fails to make desired expectations. These advantages may be obtained to varying degrees with the various embodiments of the present invention.

DETAILED DESCRIPTION OF THE INVENTION

In one embodiment, the color developing composition of this invention can be formulated as an aqueous concentrate, such as a single-part concentrate, that can then be diluted at least two times with water or buffer (preferably at least four times) to form a working strength color developing composition. Alternatively, a working strength composition of this invention can be prepared by mixing all of the desired components in any desired order at working strength concentrations. Still other embodiments of this invention include two or more part (usually two or three parts) in a color developing composition kit. Each or all parts can be in concentrated form or provided at working strength concentration, and mixed in the desired proportions to form a working strength solution. Alternatively, one or more concentrated parts can be supplied to a processing vessel as a replenishing solution.

The compositions of this invention contain one or more color developing agents that may be in the form of a sulfate salt or in free base form as a first essential component. Other essential components of the composition include one or more antioxidants for the color developing agent, and one or more of the two specific types of calcium ion sequestering agents as described below. Optional and preferred addenda are also described below.

More specifically, the color developing compositions of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art. Kodak Color Developing Agent CD-3 is preferred in the processing of photographic color papers.

In preferred embodiments of single-part concentrated compositions, the color developing agents are used in "free base form" as described in U.S. Pat. No. 6,077,651 (noted above), incorporated herein by reference.

In order to protect the color developing agents from oxidation, one or more antioxidants are generally included in the color developing compositions as a second essential component. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, 1,4-cyclohexanediones, and oximes. Mixtures of compounds from the same or different classes of antioxidants can also be used if desired.

Especially useful antioxidants are hydroxylamine or salts and hydroxylamine derivatives as described for example, in U.S Pat. No. 4,892,804 (noted above), U.S. Pat. No. 4,876,174 (noted above), U.S. Pat. No. 5,354,646 (noted above), U.S. Pat. No. 5,660,974 (noted above), and U.S. Pat. No. 5,646,327 (Burns et al.), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. More preferably, the hydroxylamine derivatives comprise one or more sulfo, carboxy, or hydroxy solubilizing groups.

Some preferred hydroxylamine derivative antioxidants include N,N-diethylhydroxylamine, N-isopropyl-N-ethylsulfonatohydroxylamine, and N,N-diethylsulfonatohydroxylamine.

The noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al.), incorporated herein by reference, and include N,N-bis(2,3-dihydroxypropyl) hydroxylamine, N,N-bis(2-methyl-2,3-dihydroxypropyl) hydroxylamine and N,N-bis(1-hydroxymethyl-2-hydroxy-3-phenylpropyl)hydroxylamine.

Many of the noted antioxidants (organic or inorganic) are either commercially available or prepared using starting materials and procedures described in the references noted above in describing hydroxylamines.

One essential component of the color developing compositions of this invention includes one or more polycarboxylic acids each having a molecular weight of from about 2000 to about 100,000 daltons and a plurality of carboxylic acids along the polymer chain. The molecular weight is preferably from about 2000 to about 10,000 daltons. These compounds include poly(acrylic acid), poly(methacrylic acid), poly(itaconic acid), poly(maleic acid), poly(aspartic acid), copolymers derived from the noted carboxylic acid monomers, and other carboxy-containing polyelectrolytes that would be readily apparent to one skilled in the art. Copolymers containing recurring units that do not have carboxy groups are also useful as long as sufficient recurring units contain carboxy groups. Poly(acrylic acid) and poly (acrylic acid-co-maleic acid), or salts thereof, are preferred. The polymers can also be provided in the form of alkali metal or ammonium salts.

These compounds can be obtained from a number of commercial sources, for example as GOODRITE® K-700 polyacrylates (from Goodrite) and poly(aspartic acid) (from Solutia, Inc.), and poly(acrylic acid) from Aldrich Chemical Company. Alternatively, the preparation of such compounds from readily available ethylenically polymerizable monomers can be carried out using well known procedures.

These polycarboxylic acids can also be supplied as polymeric anhydrides such as hydrolyzed poly(maleic anhydride) that can be formed by hydrolyzing polymerized maleic anhydride to form a product having free carboxylic acid groups and possible residual anhydride groups, on a carbon backbone. These compounds can be used in the form of water-soluble salts. Hydrolyzed poly(maleic anhydrides) can be prepared using the procedures described in U.S. Pat. No. 3,810,834 (Jones et al.) or obtained from various commercial sources.

Another essential component of the compositions of this invention includes one or more non-polymeric aminocarboxylic acids (or salts thereof) or polyphosphonic acids (or salts thereof). "Aminocarboxylic acids" is meant to include aminopolycarboxylic acids, polyaminopolycarboxylic acids, and polyaminocarboxylic acids. By "non-polymeric" is meant that the compounds generally have a molecular weight less than 500 daltons.

Aminocarboxylic acids include the many compounds known in the art that are conventionally used as ferric ion bleaching agent ligands. There are many such compounds known in the art including those described in U.S. Pat. No. 4,546,068 (Kuse), U.S. Pat. No. 4,596,765 (Kurematsu et al.), U.S. Pat. No. 4,892,804 (noted above), U.S. Pat. No. 4,975,357 (Buongiome et al.), U.S. Pat. No. 5,034,308 (Abe et al.), and *Research Disclosure* publications Item 20405 (April, 1981), Item 18837 (December, 1979), Item 18826 (December, 1979), and Item 13410 (December, 1975).

Examples of such compounds include, but are not limited to, ethylenediaminetetraacetic acid (EDTA), 1,3-propylenediaminetetraacetic acid (PDTA), diethylenetriaminepentaacetic acid (DTPA), cyclohexanediaminetetraacetic acid (CDTA), hydroxyethylethylenediaminetriacetic acid (HEDTA), ethylenediaminedisuccinic acid (EDDS) as described in U.S. Pat. No. 5,679,501 (Seki et al.) and EP-0 532,001B (Kuse et al.). Other useful disuccinic acid chelating ligands are described in U.S. Pat. No. 5,691,120 (Wilson et al.). Aminomonosuccinic acids (or salts thereof) are chelating ligands having at least one nitrogen atom to which a succinic acid (or salt) group is attached, polyamino monosuccinic acids, ethylenediamine monosuccinic acid (EDMS).

Other classes of biodegradable aminopolycarboxylic acid or polyaminopolycarboxylic acid chelating ligands that can be used to form biodegradable iron complexes include iminodiacetic acid and its derivatives (or salts thereof), including alkyliminodiacetic acids that have a substituted or unsubstituted alkyl group having 1 to 6 carbon atoms (such as methyl, ethyl, n-propyl, isopropyl, and t-butyl) as described in EP-A-0 532,003 (Kuse et al.). Particularly useful alkyliminodiacetic acids are methyliminodiacetic acid (MIDA) and ethyliminodiacetic acid (EIDA).

Still other useful aminocarboxylic acids can be represented by the following Structure I:

I

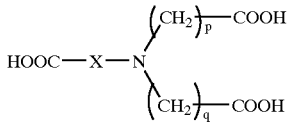

wherein p and q are independently 1, 2 and 3, and preferably each is 1. The linking group X can be H, with no carboxy group attached, or it may be any divalent group that does not bind ferric ion and does not cause the resulting ligand to be water-insoluble. Preferably, X is a substituted or unsubstituted alkylene group, substituted or unsubstituted arylene group, substituted or unsubstituted arylenealkylene group, or substituted or unsubstituted alkylenearylene group.

Still other useful aminocarboxylic acids include but are not limited to, β-alaninediacetic acid (ADA), nitrilotriacetic acid (NTA), glycinesuccinic acid (GSA), 2-pyridylmethyliminodiacetic acid (PMIDA), citric acid, tartaric acid, 1,3-diamino-2-propanetetraacetic acid (DPTA), diethylenetriaminepentaacetic acid (DTPA), and iminodisuccinic acid, and salts thereof.

Polyphosphonic acid sequestering agents are well known in the art, and are described for example in U.S. Pat. No. 4,596,765 (noted above) and *Research Disclosure* publications Item 13410 (June, 1975), 18837 (December, 1979), and 20405 (April, 1981).

Useful sequestering agents are readily available from a number of commercial sources. Particularly useful polyphosphonic acids are the diphosphonic acids (and salts thereof) and polyaminopolyphosphonic acids (and salts thereof) described below. It is preferable to use one or more compounds of these classes in combination. Useful diphosphonic acids include hydroxyalkylidene diphosphonic acids, aminodiphosphonic acids, amino-N,N-dimethylenephosphonic acids, and N-acyl aminodiphosphonic acids.

Particularly useful polyphosphonic acids (and salts thereof) are compound that have at least five phosphonic acid (or salt) groups. A mixture of such compounds can be used if desired. Suitable salts include ammonium and alkali metal ions salts.

Preferred compounds of this nature can be represented by the following Structure II:

II

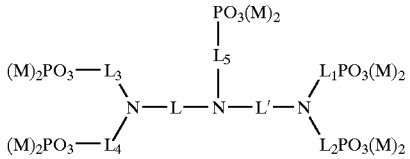

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing compositions. Such substituents include, but are not limited to, hydroxy, sulfo, carboxy, halo, lower alkoxy (1 to 3 carbon atoms) or amino.

A particularly useful sequestering agent of this type is diethylenetriaminepentamethylenephosphonic acid or an alkali metal salt thereof (available as DEQUEST™ 2066 from Solutia Co.).

Still another polyphosphonic acid includes hydroxyalkylidene diphosphonic acids (or salts thereof). Mixtures of such compounds can be used if desired. Useful salts include the ammonium and alkali metal ion salts.

Preferred hydroxyalkylidene diphosphonic acids (or salts thereof) can be represented by the following Structure III:

III

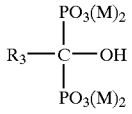

wherein $R_3$ is a substituted or unsubstituted alkyl group having 1 to 5 carbon atoms (methyl, methoxymethyl, ethyl, isopropyl, n-butyl, t-butyl and n-pentyl)and M is hydrogen or a monovalent cation (such as ammonium or alkali metal ions). Preferably, $R_3$ is methyl or ethyl, and most preferably, it is ethyl.

Representative sequestering agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST™ 2010, and its tetrasodium salt is available as DEQUEST™ 2016D, both from Solutia Co.

Another useful sequestering agent is morpholinomethanediphosphonic acid or a salt thereof that is available as BUDEX™ 5103 from Budenheim (Germany). This and similar cyclicaminodiphosphonic acids (and salts thereof) are described in U.S. Pat. No. 4,873,180 (Marchesano et al.).

The weight ratio of the first calcium ion sequestering agent to the second calcium ion sequestering agent is generally from about 1:1 to about 20:1. Preferably, the weight ratio is from about 1:1 to about 15:1.

Buffering agents are generally present in the color developing compositions of this invention to provide or maintain desired alkaline pH of from about 7 to about 13, and preferably from about 8 to about 12. These buffering agents are preferably soluble in the organic solvent described below and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred buffering agents. Mixtures of buffering agents can be used if desired.

In addition to buffering agents, pH can also be raised or lowered to a desired value using one or more acids or bases. It may be particularly desirable to raise the pH by adding a base, such as a hydroxide (for example sodium hydroxide or potassium hydroxide), in the various "parts" or solutions of the color developing kits.

An optional but preferred component of the single-part color developing compositions of this invention is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and trietbylene glycol), polyhydroxyamines (including polyalcoholamines), and alcohols (such as ethanol). Glycols are preferred with ethylene glycol, diethylene glycol and trietbylene glycol being most preferred. The most preferred organic solvent is diethylene glycol.

It is also possible to include other metal ion sequestering agents (for example, for iron, copper, and/or manganese ion sequestration) in the color developing composition as long as the other conditions of the invention are met.

The color developing compositions of this invention can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color couplers, as would be readily understood by one skilled in the art [see for example, *Research Disclosure* publications noted above]. The amounts of such additives are well known in the art also. Representative color developing compositions of this invention are described below in the examples.

It is preferred that no lithium or magnesium ions are purposely added to the color developing compositions of this invention. Depending upon the concentrations of such ions in water used to make up processing solutions, or carried over from previous processing baths, the total concentration (that is, the sum) of these ions remains preferably very low, that is less than 0.0001 mol/l in the compositions, and preferably a total of less than 0.00001 mol/l.

The following TABLES I and II list the general and preferred amounts of the essential and some optional components of the color developing compositions (concentrates and working strength compositions, respectively) of this invention. The preferred ranges are listed in parentheses (), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE I (CONCENTRATES)

| COMPONENT | CONCENTRATIONS |
|---|---|
| Color developing agent(s) | 0.005–1 mol/l<br>(0.05–0.8 mol/l) |
| Antioxidant(s) | 0.005–1 mol/l<br>(0.05–1 mol/l) |
| Buffering agent(s) | 0.5–3 mol/l<br>(1.5–2.5 mol/l) |
| First Calcium Ion Sequestering Agent(s) | 1–50 g/l<br>(2–40 g/l) |
| Second Calcium Ion Sequestering Agent(s) | 0.001–0.3 mol/l<br>(0.01–0.1 mol/l) |

TABLE II (WORKING STRENGTH)

| COMPONENT | CONCENTRATIONS |
|---|---|
| Color developing agent(s) | 0.0005–0.25 mol/l<br>(0.005–0.03 mol/l) |
| Antioxidant(s) | 0.0005–0.25 mol/l<br>(0.005–0.05 mol/l) |
| Buffering agent(s) | 0.002–0.8 mol/l<br>(0.01–0.5 mol/l) |
| First Calcium Ion Sequestering Agent(s) | 1–25 g/l<br>(1–20 g/l) |
| Second Calcium Ion Sequestering Agent(s) | 0.0005–0.05 mol/l<br>(0.001–0.01 mol/l) |

The following TABLES III, IV, and V show general and preferred concentrations for multi-part color developing compositions of this invention.

TABLE III

| FIRST SOLUTION | |
|---|---|
| COMPONENT | CONCENTRATIONS |
| Antioxidant(s) | 0–2 mol/l (0.05–1.5 mol/l) |
| First Calcium Ion | 0–50 g/l |
| Sequestering Agent | (2–40 g/l) |
| Second Calcium Ion | 0–0.3 mol/l |
| Sequestering Agent | (0.001–0.1 mol/l) |
| pH | 9–13 (9–11) |

TABLE IV

| SECOND SOLUTION | |
|---|---|
| COMPONENT | CONCENTRATIONS |
| Color developing agent(s) | 0.005–1 mol/l (0.05–0.8 mol/l) |
| Sulfite ions | 0.001–0.5 mol/l (0.01–0.3 mol/l) |
| Antioxidant | 0–2.5 mol/l (0.02–2 mol/l) |
| Second Calcium Ion | 0–0.3 mol/l |
| Sequestering Agent | (0.001–0.1 mol/l) |
| pH | 1–4 (1–3.75) |

TABLE V

| THIRD SOLUTION | |
|---|---|
| COMPONENT | CONCENTRATIONS |
| Buffer(s) | 0.5–7.5 mol/l (1.5–6 mol/l) |
| Halide ions | 0.001–1 mol/l (0.05–0.8 mol/l) |
| Antioxidant | 0–2.5 mol/l (0.02–2 mol/l) |
| First Calcium Ion | 0–50 g/l |
| Sequestering Agent | (2–40 g/l) |
| Second Calcium Ion | 0–0.3 mol/l |
| Sequestering Agent | (0.001–0.1 mol/l) |
| pH | 7–14 (10–14) |

The following TABLES VI and VII list the general and preferred amounts of the essential and some optional components of the first and second aqueous solutions used in the two-part color developing kits of this invention. The preferred ranges are listed in parentheses (), and all of the ranges are considered to be approximate or "about" in the upper and lower end points. During color development, the actual concentrations can vary depending upon extracted chemicals in the composition, replenishment rates, water losses due to evaporation and carryover from any preceding processing bath and carryover to the next processing bath. The amounts are total concentrations for the various components that can be present in mixtures.

TABLE VI

| FIRST SOLUTION | |
|---|---|
| COMPONENT | CONCENTRATIONS |
| Buffer(s) if present | 0.5–7.5 mol/l (1.5–6 mol/l) |

TABLE VI-continued

| FIRST SOLUTION | |
|---|---|
| COMPONENT | CONCENTRATIONS |
| First Calcium Ion | 1–50 g |
| Sequestering Agent | (2–40 g) |
| Second Calcium Ion | 0–0.3 mol/l |
| Sequestering Agent | (0.001–0.1 mol/l) |
| Antioxidant(s) | 0.005–2 mol/l |
| (if present) | (0.05–1.5 mol/l) |
| pH | 9–13 (9–11) |

TABLE VII

| SECOND SOLUTION | |
|---|---|
| COMPONENT | CONCENTRATIONS |
| Color developing agent(s) | 0.005–1 mol/l (0.05–0.8 mol/l) |
| Sulfite ions | 0.001–0.5 mol/l (0.01–0.3 mol/l) |
| Antioxidant(s) | 0.005–2 mol/l |
| (if present) | (0.05–1.5 mol/l) |
| Second Calcium Ion | 0–0.3 mol/l |
| Sequestering Agent | (0.001–0.1 mol/l) |
| pH | 3–7 (4–6) |

The color developing compositions of this invention have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see *Research Disclosure* publication 38957 noted above). In particular, the invention can be used to process color photographic papers of all types of emulsions including so-called "high chloride" and "low chloride" type emulsions, and so-called tabular grain emulsions as well. The color developing composition can also be used in processing of color reversal and color negative films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Representative commercial color papers that are useful in the practice of this invention include, but are not limited to, KODAK EKTACOLOR EDGE 5, 7, 8, and 9 Color Papers (Eastman Kodak Company), KODAK EKTACOLOR ROYAL VII and VIII Color Papers (Eastman Kodak Company), KODAK PROFESSIONAL PORTRA IV Color Papers (Eastman Kodak Company), KODAK PROFESSIONAL SUPRA III and IV Color Papers (Eastman Kodak Company), KODAK PROFESSIONAL ULTRA III Color Papers (Eastman Kodak Company), KODAK PROFESSIONAL METALLIC Color Papers (Eastman Kodak Company), KODAK DURALIFE Color Paper (Eastman Kodak Company), KODAK PROFESSIONAL PORTRA Black and White Papers (Eastman Kodak Company), FUJI SUPER Color Papers (Fuji Photo Co., FA5, FA7 and FA9), FUJI CRYSTAL ARCHIVE and Type C and D Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art.

KODAK PROFESSIONAL DURATRANS display materials, KODAK DURACLEAR, KODAK EKTAMAX RAL and KODAK PROFESSIONAL DURAFLEX print materials, and KODAK PROFESSIONAL Digital III Color Paper Type can also be processed using the present invention. The compositions and constructions of such commercial color photographic elements could be readily determined by one skilled in the art.

Color development of an imagewise exposed photographic silver halide element is carried out by contacting the element with a color developing composition of this invention under suitable time and temperature conditions, in suitable processing equipment, to produce the desired developed color image. Additional processing steps can then be carried out using conventional procedures, including but not limited to, one or more color development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 noted above. Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The color developing composition of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes included in what are known as "minilabs." Such processing methods and equipment are described, for example, in U.S. Pat. No. 5,436,118 (Carli et al.) and publications noted therein. Some minilab processing machines are commercially available as Noritsu 2211SM Printer/Paper Processor, Noritsu 2102SM Printer/Paper Processor, and Noritsu 2301SM Printer/Paper Processor.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in *Research Disclosure* publication 38957 noted above, U.S. Pat. No. 5,582,958 (Buchanan et al.) and U.S. Pat. No. 5,753,423 (Buongiorne et al.). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP 0 532,003A1 (Ueda et al.), and ethylenediamine monosuccinic acid and similar compounds as described in U.S. Pat. No. 5,691,120 (Wilson et al.). Useful fixing agents are also well known in the art and include various thiosulfates and thiocyanates or mixtures thereof as described for example in U.S. Pat. No. 6,013,424 (Schmittou et al.). These references are incorporated herein by reference.

Rinsing and/or stabilizing steps can be carried out after desilvering if desired using various rinsing or stabilizing compositions that may include one or more anionic or nonionic surfactants. Representative compositions and conditions for this purpose are, for example, described in U.S. Pat. No. 5,534,396 (McGuckin et al.), U.S. Pat. No. 5,578,432 (McGuckin et al.), U.S. Pat. No. 5,645,980 (McGuckin et al.), U.S. Pat. No. 5,667,948 (McGuckin et al.), and U.S. Pat. No. 5,716,765 (McGuckin et al.), all incorporated herein by reference.

The processing time and temperature used for each processing step of the present invention are generally those conventionally used in the art. For example, color development is generally carried out at a temperature of from about 20 to about 60° C. The overall color development time can be up to 40 minutes, and preferably from about 25 to about 450 seconds. The shorter overall color development times are desired for processing color photographic papers. Conventional conditions can be used for other processing steps including desilvering and rinsing/stabilizing.

The color developing compositions of this invention can be used as working strength solutions, or as replenishers. Alternatively, the concentrated compositions of this invention can be diluted at least two times (that is, one volume composition to one volume water or buffer), and preferably at least four times, and up to 8 times, to provide a working strength solution or replenisher.

The following examples are provided to illustrate the practice of this invention and not to limit it in any way. Unless otherwise indicated, percentages are by weight.

EXAMPLE 1

Color Developing Compositions and Turbidimetric Titration

A color developing composition was prepared as described in the following TABLE VIII and used as the Control composition for following experiments.

TABLE VIII

| COMPONENT | AMOUNT |
|---|---|
| Versa TL 74 (sulfonate polystyrene) (30%) | 017 g |
| Potassium sulfate (45%) | 0.84 g |
| Triethanolamine (85%) | 7.3 g |
| N,N-diethylhydroxylamine | 5.4 g |
| Phorwite REU optical brightener | 1.1 g |
| Lithium sulfate | 2.0 g |
| Magnesium sulfate | 0.2 g |
| DEQUEST ™ 2010 sequestering agent | 0.86 g |
| Potassium chloride | 4 g |
| Potassium bromide | 0.03 g |
| KODAK Color Developing Agent CD-3 | 6.8 g |
| Potassium hydroxide (50%) | 5 g |
| Potassium carbonate (47%) | 52.6 g |
| Water | To make 1 liter |

*pH was adjusted to 10.8 using sulfuric acid or potassium hydroxide.

In order to evaluate the effectiveness of the various compounds to prevent calcium precipitation in the color developing compositions, tests were conducted in which the different "additives" listed in the following TABLE IX were titrated to a permanent turbidity using 0.25–0.5 mol/l calcium chloride solutions at room temperature. Included within TABLE IX are the results of the titration that show that polymers formed from acrylic acid and/or other monomers (polyelectrolytes) provided significant improvement in reduced calcium complexation over some of the common sequestering agents known in the art and used in color developing compositions.

TABLE IX

| Sequestrant Additive | Amount | $Ca^{2+}$ (ppm) |
|---|---|---|
| None (Control) | | 90 |
| DEQUEST ™ 2010 sequestering agent | 2 mM | 210 |
| Nitrilotriacetic acid | 2 mM | 190 |
| 1,3-Diamino-2-propane-2-ol-tetraacetic acid | 2 mM | 190 |
| Diethylenetriaminepentaacetic acid, pentasodium salt (40%) | 4 mM | 250 |
| Ethylenediaminetetraacetic acid | 3.4 mM | 200 |
| DEQUEST ™ 2066 sequestering agent | 2 mM | 280 |
| Poly(acrylic acid) (25%) | 11 g/l | 210 |
| Poly(acrylic acid) (50%) | 5 g/l | 215 |
| Poly(acrylic acid) (65%) | 3.25 g/l | 215 |
| Poly(acrylic acid-co-maleic acid) | 5 g/l | 280 |
| Poly(acrylic acid) (50%) | 15 g/l | >370 |
| Poly(acrylic acid) (25%) | ~20 g/l | >1000 |
| Poly(acrylic acid) (50%) | ~20 g/l | >1000 |
| Poly(acrylic acid) (65%) | ~20 g/l | >1000 |
| Poly(acrylic acid-co-maleic acid) | ~20 g/l | >1000 |

EXAMPLE 2

Kinetics of Ektacolor RA Developers with 300 ppm $Ca^{+2}$ Ions

Although turbidimetric titration is useful for comparing the complexing ability of the sequestering agents in the fresh color developing composition, it does not predict the keeping stability of the composition or the occurrence of scale formation in the present of calcium ions. To determine the kinetic behavior of the color developing composition with time, standing solutions of commercially available KODAK EKTACOLOR Prime RA or Prime SP containing the various sequestering agent additives and 300 ppm calcium ions in contact with conventional Tygon tubing were monitored for precipitate formation or scale at room temperature and about 38° C.

As predicted by the turbidimetric titration, the aminocarboxylic acid or aminophosphonic acid sequestering agents that controlled less that 300 ppm calcium, immediately produced precipitation and or scale on the tubing similar to that seen with the commercially available EKTACOLOR™ Prime RA or in an EKTACOLOR™ Prime SP Developers. Surprisingly however, the poly(acrylic acid) polymers also produced precipitate and or scale on the tubing within one week. When the poly(acrylic acid) polymers were combined with aminocarboxylic acid or aminophosphonic acid sequestering agents, and with 300 ppm calcium ions, no precipitates or scale was seen after four weeks standing. These results are shown below in TABLE X.

Thus, use of a mixture of specific sequestering agents according to the present invention is effective in reducing calcium salts and the adverse effects of silver precipitation that are seen when common calcium ion sequestering agents such as diethylenetriaminepentaacetic acid, pentasodium salt, and ethylenediaminetetraacetic acid, are used at high levels.

TABLE X

| Sequestrant Additive | Amount | 4 weeks |
|---|---|---|
| EKTACOLOR ™ Prime RA | | precipitate |
| DEQUEST ™ 2010 sequestering agent | 2 mM | precipitate |
| Nitrilotriacetic acid | 2 mM | precipitate |
| 1,3-Diamino-2-propanetetraacetic acid | 2 mM | precipitate |
| Diethylenetriaminepentaacetic acid, pentasodium salt (40%) | 4 mM | precipitate |
| Ethylenediaminetetraacetic acid | 3.4 mM | precipitate |
| DEQUEST ™ 2066 sequestering agent | 2 mM | precipitate |
| Polyacrylic acid (25%) | ~20 g/l | precipitate |
| Polyacrylic acid (50%) | ~20 g/l | precipitate |
| Polyacrylic acid (65%) | ~20 g/l | precipitate |
| Poly(acrylic acid-co- maleic acid) | ~20 g/l | precipitate |
| Polyacrylate(50%)/DEQUEST ™ 2010 sequestering agent | 5 g/l/ 2 mM | clear |
| Polyacrylate(50%)/nitrilotriacetic acid | 17 g/l/ 2 mM | clear |
| Polyacrylate(50%)/Diethylenetriamine-pentaacetic acid, pentasodium salt (40%) | 17 g/l/ 2 mM | clear |
| Polyacrylate(50%)/1,3-diamino-2-propanetetraacetic acid | 15 g/l/ 2 mM | clear |
| Polyacrylate(50%)/DEQUEST ™ 2066 sequestering agent | 5 g/l/ 2 mM | clear |
| Polyacrylate(50%)/-ethylenediaminetetraacetic acid | 15 g/l/ 3.4 mM | clear |
| Polyacrylate(65%)/DEQUEST ™ 2066 sequestering agent | 9.2 g/l/ 2 mM | clear |
| Poly(acrylic acid-co-maleic acid)/DEQUEST ™ 2066 sequestering agent | 5 g/l/ 2 mM | clear |
| Poly(acrylic acid-co-maleic acid)/DEQUEST ™ 2066 sequestering agent | 10.2 g/l/ 2 mM | clear |

TABLE X-continued

| Sequestrant Additive | Amount | 4 weeks |
|---|---|---|
| EKTACOLOR ™ Prime SP | | precipitate |
| DEQUEST ™ 2066 sequestering agent | 2 mM | precipitate |
| Poly(acrylic acid) (50%) | 15 g/l | precipitate |
| Polyacrylate(50%)/DEQUEST ™ 2066 sequestering agent | 5 g/l/ 2 mM | clear |
| Polyacrylate(50%)/DEQUEST ™ 2066 sequestering agent | 15 g/l/ 2 mM | clear |
| Polyacrylate(50%)/morpholinomethane-diphosphonic acid | 5 g/l/ 2 mM | clear |

EXAMPLE 3

Use of a Polyacrylic acid in Part A of Kit

A three-part color developing kit of this invention was formulated with the following components in the three separate parts (solutions):

| | | CONCENTRATION (g/l) | |
|---|---|---|---|
| PART | COMPONENT | Comparison | Invention |
| A (pH 10.5) | Triethanolamine (85%) | 157.6 | 157.6 |
| | N,N-Diethylhydroxylamine (85%) | 115.96 | 115.96 |
| | Phorwite REU optical brightener | 23.84 | 23.84 |
| | Versa-TL 74 (30%) sulfonated polystyrene | 3.7 | 3.7 |
| | Poly(acrylic acid) (50%) | 0 | 215 |
| B (pH 1.2) | Kodak Color Developing Agent CD-3 | 295.65 | 295.65 |
| | Lithium sulfate | 86.96 | 86.96 |
| | Magnesium sulfate.$7H_2O$ | 9.0 | 9.0 |
| | Potassium sulfite (45%) | 36.3 | 36.3 |
| C (pH 13.0) | Potassium hydroxide (49%) | 63.02 | 63.02 |
| | Potassium chloride | 59.97 | 59.97 |
| | Potassium bromide | 0.375 | 0.375 |
| | DEQUEST ™ 2010 sequestering agent (60%) | 12.89 | 12.89 |
| | Potassium carbonate (47%) | 789.1 | 789.1 |

Each of solutions A, B, and C was diluted to 1 liter with water. Lithium and magnesium sulfates can be removed if DEQUEST™ 2066 sequestering agent or polycarboxylic acid sequestering agent is used instead of DEQUEST™ 2010 sequestering agent in Part C. Approximately 46.5 ml of Part A, 23.0 ml of Part B, and 66.7 ml of Part C were combined and diluted to make 1 liter of a working strength color developing solution.

EXAMPLE 4

Use of a Polyacrylic acid (50%) in Part C of Kit

In this embodiment of the invention, the polyacrylic acid sequestering agent was placed in the Part C solution. The three parts (solutions) had the following components:

| | | CONCENTRATION (g/l) | |
|---|---|---|---|
| PART | COMPONENT | Comparison | Invention |
| A (pH 10.5) | Triethanolamine (85%) | 157.6 | 157.6 |
| | N,N-Diethylhydroxylamine (85%) | 115.96 | 115.96 |
| | Phorwite REU (180) optical brightener | 23.84 | 23.84 |
| | Versa-TL 74 (30%) sulfonated polystyrene | 3.7 | 3.7 |
| B (pH 1.2) | Kodak Color Developing Agent CD-3 | 295.65 | 295.65 |
| | Lithium sulfate | 86.96 | 86.96 |
| | Magnesium sulfate.$7H_2O$ | 9.0 | 9.0 |
| | Potassium sulfite (45%) | 36.3 | 36.3 |
| C (pH 13.0) | Potassium hydroxide (49%) | 68.62 | 68.62 |
| | Potassium chloride | 59.97 | 59.97 |
| | Potassium bromide | 0.375 | 0.375 |
| | DEQUEST ™ 2010 sequestering agent (60%) | 12.89 | 12.89 |
| | Polyacrylic acid (50%) | 0 | 150 |
| | Potassium carbonate (47%) | 789.1 | 789.1 |

Lithium and magnesium sulfate in Part B are optional. Approximately 46.5 ml of Part A, 23.0 ml of Part B, and 66.7 ml of Part C were combined and diluted to make 1 liter of a working strength color developing solution.

EXAMPLE 5

Color Paper Processing

Samples of KODAK Edge 8 Color Paper were given a step wedge test object exposure at 1/10 sec with HA-50, NP-11 filters, and 0.3 Inconel on a conventional 1B sensitometer. The samples were then processed using a color developing composition provided by combining the three solutions of the multi-part color developing kit of Example 3. Processing was carried out in a deep tank processor using conventional EKTACOLOR Process RA-4 conditions and steps as follows:

| | | |
|---|---|---|
| Color Development | 38° C. | 45 seconds |
| Bleach/fixing | 35° C. | 45 seconds |
| Washing/Stabilizing | 35° C. | 90 seconds |

Bleach/fixing was carried out using commercially available KODAK EKTACOLOR™ Prime Bleach-Fix and the washing step was carried out using KODAK EKTACOLOR™ Prime Stabilizer. After processing, the color paper samples were allowed to dry in the air at ambient temperature. The desired colored images were obtained in all of the samples.

EXAMPLE 6

Two-part Color Developing Kit

A two-part color developing kit of the present invention was prepared with two following solutions:

| PART | COMPONENTS | CONCENTRATION (g/l) |
|---|---|---|
| A (pH 11.4) | Potassium hydroxide (49%) | 40 |
| | Triethanolamine (85%) | 58.4 |
| | DEQUEST ™ 2066 (25%) sequestering agent | 41.6 |
| | Versa-TL 74 (30%) sulfonated | 1.36 |

-continued

| PART | COMPONENTS | CONCENTRATION (g/l) |
|---|---|---|
| | polystyrene | |
| | Potassium chloride | 32 |
| | Potassium bromide | 0.24 |
| | Polyacrylic acid (50%) | 280 |
| | Potassium carbonate | 420.8 |
| B | Potassium sulfite (45%) | 6.72 |
| (pH 5.7) | N,N-Diethylhydroxylamine (85%) | 43.2 |
| | KODAK Color Developing Agent CD-3 | 54.4 |
| | Phorwite REU (180) optical brightener | 8.8 |

In this example approximately 125 ml of Part A and 125 ml Part B were combined and diluted to make 1 liter of working strength developing composition. The final composition pH was 10.8.

The resulting color developing composition was used for color development of imagewise exposed samples of commercially available Kodak Ektacolor Edge VIII Color Paper samples in a deep-tank conventional RA-4 process as described in Example 5. The desired color images were obtained.

EXAMPLE 7

Color Paper Processing Using KODAK EKTACOLOR™ Prime SP Developing Composition A concentrate was prepared as described below in g/l:

| | |
|---|---|
| Water | 50.3 |
| DEQUEST ™ 2010 sequestering agent | 0.55 |
| Potassium carbonate (47%) | 353.3 |
| Potassium bicarbonate | 14.6 |
| Potassium bromide | 0.19 |
| DEQUEST ™ 2066 | 40 |
| Triethanolamine (85%) | 23 |
| Diethylene glycol | 129 |
| Poly(acrylic acid) | 38.46 |
| Premix 1* | 590 |

*Premix 1 contained the N,N-diethylhydroxylamine antioxidant (0.4 mol/l) and KODAK Color Developing Agent CD-3 (0.12 mol/l).

A sample (130 ml) of this concentrated formulation was diluted to make a liter working strength developer that had a pH of 10.86. Samples of KODAK EDGE™ 8 Color Paper were given a step wedge test object exposure at 1/10 sec with HA-50, NP-11 filters, and 0.3 Inconel on a conventional 1B sensitometer. The samples were then processed using the aforementioned working strength color developing composition. Processing was carried out in a deep tank processor using conventional EKTACOLOR™ Process RA-4 conditions and steps as follows:

| | | |
|---|---|---|
| Color Development | 38° C. | 45 seconds |
| Bleach/fixing | 35° C. | 45 seconds |
| Washing/Stabilizing | 35° C. | 90 seconds |

Bleach/fixing was carried out using commercially available KODAK EKTACOLOR™ Prime Bleach-Fix and the washing step was carried out using KODAK EKTACOLOR™ Prime Stabilizer. After processing, the color paper samples were allowed to dry in the air at ambient temperature. The desired colored images were obtained in all of the samples.

The invention has been described in detail with particular reference to preferred embodiments thereof, but it will be understood that variations and modifications can be effected within the spirit and scope of the invention.

We claim:

1. A two-part color developing composition kit comprising:

I) a first aqueous solution having a pH of from about 9 to about 13, and

II) a second aqueous solution having a pH of from about 3 to about 7 and comprising:

(a) at least 0.005 mol/l of a color developing agent, (b) at least 0.005 mol/l of an antioxidant for said color developing agent, and (c) at least 0.001 mol/l of sulfite ions, further comprising, in said first aqueous, from about 1 to about 50 g/l of a first calcium ion sequestering agent that is a polycarboxylic acid or salt thereof having a molecular weight of from about 2000 to about 10,000, and in said first or second aqueous solution, or both, at least 0.0005 mol/l of a second calcium ion sequestering agent that is a non-polymeric aminocarboxylic acid, polyphosphonic acid, or a salt thereof, wherein the weight ratio of said first calcium ion sequestering agent to said second calcium ion sequestering agent is from about 1:1 to about 20:1 when said first and second aqueous solutions are mixed at a volume ratio of from about 2:1 to about 1:2.

2. A three-part color developing kit comprising:

(I) a first concentrated aqueous solution having a pH of from about 9 to about 13, (II) a second concentrated aqueous solution having a pH of from about 1 to about 4 and comprising:

(a) at least 0.0005 mol/l of a color developing agent, and (b) at least 0.0005 mol/l of sulfite ions, and (III) a third concentrated aqueous solution having a pH of from about 10 to about 13.5, wherein said first or second concentrated aqueous solution, or both, includes from about 1 to about 50 g/l of a first calcium ion sequestering agent that is a polycarboxylic acid or salt thereof having a molecular weight of from about 2000 to about 10,000, any of said first, second, and third concentrated aqueous solutions includes at least 0.001 mol/l of a second calcium ion sequestering agent that is a non-polymeric aminocarboxylic acid, polyphosphonic acid, or a salt thereof, and any of said first, second, and third concentrated aqueous solutions includes at least 0.005 mol/l of an antioxidant for said color developing agent, wherein the weight ratio of said first calcium ion sequestering agent to said second calcium ion sequestering agent is from about 1:1 to about 20:1 when said first, second, and third concentrated aqueous solutions are mixed at a volume ratio of 2:1:3.

3. The color developing composition kit of claim 1 wherein said color developing agent is present in said second aqueous solution an amount of from about 0.05 to about 0.8 mol/l, and said antioxidant is a hydroxylamine derivative that is present in an amount of from about 0.05 to about 1 mol/l.

4. The color developing composition kit of claim 1 wherein said antioxidant has one or more sulfo, carboxy, or hydroxy solubilizing groups.

5. The color developing composition kit of claim 1 wherein said second aqueous solution further comprises a water-miscible or water-soluble hydroxy-substituted, straight-chain organic solvent that has a molecular weight of from about 50 to about 200.

6. The color developing composition kit of claim 5 further comprising a buffering agent that is soluble in said organic solvent.

7. The color developing composition kit of claim 1 wherein the weight ratio of said first calcium ion sequestering agent to said second calcium ion sequestering agent in either said first or second aqueous solution is from about 1:1 to about 15:1.

8. The color developing composition kit of claim 1 wherein said first calcium ion sequestering agent is a poly (acrylic acid), poly(methacrylic acid), poly(maleic acid), or poly(itaconic acid), poly(aspartic acid) or copolymers derived from acrylic acid, methacrylic acid, maleic acid, aspartic acid, or itaconic acid.

9. The color developing composition kit of claim 1 wherein said first calcium ion sequestering agent is polyacrylic acid, poly(acrylic acid-co-maleic acid), or a salt thereof of either of these polymers.

10. The color developing composition kit of claim 1 wherein said first calcium ion sequestering agent is polyacrylic acid, poly(acrylic acid-co-maleic acid), or a salt thereof and said second calcium ion sequestering agent is diethylenetriaminepentamethylenephosphonic acid, morpholinomethanediphosphonic acid, or a salt thereof.

11. The color developing kit of claim 2 wherein said first calcium ion sequestering agent is poly(acrylic acid) or a salt thereof, and said second calcium ion sequestering agent that is diethylenetriaminepentamethylenephosphonic acid, morpholinomethanediphosphonic acid, or a salt of either of these compounds.

* * * * *